US011304552B2

(12) United States Patent
Ng

(10) Patent No.: US 11,304,552 B2
(45) Date of Patent: Apr. 19, 2022

(54) REUSABLE AND WASHABLE STRAW

(71) Applicant: Sabrina Sze Wing Ng, El Monte, CA (US)

(72) Inventor: Sabrina Sze Wing Ng, El Monte, CA (US)

( * ) Notice: Subject to any disclaimer, the term of this patent is extended or adjusted under 35 U.S.C. 154(b) by 154 days.

(21) Appl. No.: 16/733,161

(22) Filed: Jan. 2, 2020

(65) Prior Publication Data

US 2020/0214485 A1 Jul. 9, 2020

Related U.S. Application Data

(60) Provisional application No. 62/788,649, filed on Jan. 4, 2019.

(51) Int. Cl.
*A47G 21/18* (2006.01)

(52) U.S. Cl.
CPC ..... *A47G 21/18* (2013.01); *A47G 21/189* (2013.01)

(58) Field of Classification Search
CPC ..... A47G 21/18; A47G 21/189
USPC ..... 239/33; 138/162, 166
See application file for complete search history.

(56) References Cited

U.S. PATENT DOCUMENTS

| | | | | |
|---|---|---|---|---|
| 2018/0160831 | A1* | 6/2018 | Yoo | A47G 21/18 |
| 2019/0038058 | A1* | 2/2019 | Abbott-Glazier | A47G 21/18 |
| 2020/0128986 | A1* | 4/2020 | Tran | A47G 21/18 |

* cited by examiner

*Primary Examiner* — Steven J Ganey
(74) *Attorney, Agent, or Firm* — Gary F. Wang, Esq.

(57) ABSTRACT

The invention of this straw is designed to turn the straw into one of reusable tableware, thereby reducing or even avoiding the use of disposable plastic straws, reducing their negative impact on the environment and health, and improving people's lives. Reducing the amount of disposable plastic straws is one of the most effective ways to reduce the damage of plastic waste to the nature. The straw in this invention has a pair of tabs affixed to the edge of the straw opening for easy opening of the straw.

17 Claims, 12 Drawing Sheets

REUSABLE AND WASHABLE STRAW

CROSS-REFERENCE

This application claims the benefit of priority of earlier filed U.S. Provisional Patent Application Ser. No. 62/788,649 filed Jan. 4, 2019.

TECHNICAL FIELD OF THE DISCLOSURE

This embodiment relates in general to straws for drinks. More specifically, the preferred embodiment relates to straws that can be opened up or unfolded for wash after use and then closed for reuse.

BACKGROUND OF THE INVENTION

Straws are used in everyday life for the purpose of sucking up liquid, such as water and drinks. Due to the large use of disposable plastic straws in modern life, resulting in increasingly serious environmental problems and health problems, has aroused high concern and attention of all sectors of the society.

The invention of this straw (also refers as the pipette) is designed to turn the straw into one of reusable tableware, thereby reducing or even avoiding the use of disposable plastic straws, reducing their negative impact on the environment and health, and improving people's lives. Reducing the amount of disposable plastic straws is one of the most effective ways to reduce the damage of plastic waste to the nature.

To solve the problem of cleaning and disinfecting the inside of the straw when the straw is reused, it becomes safe tableware that can be handled in the dishwasher or other automated cleaning and disinfection equipment.

When the straw is no longer a fast-moving consumer goods (FMCG), but a reusable tableware, we have the condition to adopt a more durable and human health-friendly material, to solve the industrial residues caused by disposable plastic straws and the harmful effects of chemical substances on human health in the event of heat.

It is documented that the first known modern straws for drinking purposes were made by the Sumerians several thousand years ago. The earlier straws were made of gold. They were used for drinking beer in order to avoid the solid byproducts of fermentation that sink to the bottom. The rye grass straws were used in 1800s because they were cheap and soft, but they had tendency to turn to mush in liquid. The wax paper straws were patented in 1888 to avoid the rye grass straws' problems.

Straw is the use of the principle of atmospheric pressure. Using the suction of the air in the inner part of the straw resulting in a small tube pressure. In order to balance the pressure, the pressure outside the tube forcing liquid pressure into the suction tube. This results in the liquid surface rise. Continuing to suck the straw, one can make the liquid to rise continuously and achieve the drinking purpose.

Assuming that the power of the sucking straw can be infinitely large, the height of the liquid level in the straw tube is determined by the strength of the tube wall. Assuming that the strength of the pipe wall can be infinite, then the height limit of the liquid level rise in the pipe is the level at which the atmospheric pressure can be pressed out. A standard atmospheric pressure, the height limit of mercury rise is 76 cm and the height limit of water rise is about 1033.6 cm. The above laws are assumed to be good air tightness of the pipe wall, non-leakage of the case Occurs. Since the length of the drink straw used in daily life is only between 10 cm to 40 cm, the height of the liquid level in the tube that the sucking beverage needs to reach is much lower than the above limit value. Therefore, the pipe wall does not need high air tightness requirement. In fact, after experiment, even if we in a 20 cm long diameter of 5 mm beverage straw above the level of the water cup two 1 mm diameter holes, still do not affect the use of straws. We can use A straw to drink water, and suck the drink when inhaled some bubbles. It is shown that the beverage straw is not high in air tightness. So long as it can improve the processing precision of the pipe wall of the tube, even if the pipe wall of the tube has a connecting seam, it can be used as the existing seamless straw.

Design a beverage straw that can be unfolded, re-used again, and easy to clean inside. The main issue is to solve two problems. First of all, since the straw is designed to be opened up or unfolded to clean and disinfect the internal structure. A method needs to be used to allow the straw to be reassembled into a tubular form, and solving the connection problem from "flat" or "curved" re-assembled into a "tubular" form. This design needs to be simple, effective, easy to manufacture and easy to use. This part of the design is call "Folding and Reassemble Design." Secondly, choose durable and environmentally friendly materials to manufacture the straws. This part of design is called "material selection."

Because of the protection of environment and creation of a durable tableware, use the "Folding and Reassemble Design" of the straw as a novel straw design is the key of the invention described in this patent application.

SUMMARY OF THE INVENTION

The invention has several different embodiments to achieve the goal of having the Folding and Reassemble Design of the straws.

The invention has several embodiments to achieve the goal of having a washable and reusable straw. The straw is made of any semi-rigid materials. The straw material needs to tolerate a relatively high temperature, such as steam temperature, in order for high-enough temperature to disinfect the straw after it is washed. The straw material needs also to be flexible enough to be opened at the connective joint or hinge of the straw.

A typical embodiment of the invention is a straw with an elongated tube body, a closeable opening, and a pair of tabs. The opening is along the longitudinal wall of the straw. The opening has two edges along the opening. The straw can be closed by pushing the tabs along with the edges of the opening toward each other. The tabs are affixed on the edges of the opening with one tab on each edge. Each tab is affixed to a position on one edge slightly different from the other tab's affixed position. This positioning scheme is to ensure an easy separation of the tabs, thereby separating the edges of the opening from each other. The tabs can have variety of different shapes such as square, rectangle, triangle, etc.

The straw wall has a predetermined thickness. Depending upon the size of the straw, the thickness of the wall can be in a range approximately from 0.5 mm to 4 mm.

A straw has a connective joint, an interlock mechanism at the edges of the opening, and another interlock mechanism close to the connective joint. The connective joint can also be called as a hinge. The connective joint connects two half straw together when the straw is in an opened state. The thickness of the straw wall at the connective joint is thinner than the rest of the straw wall, so that the straw can be easily opened and closed. The connective joint can have many different designs.

The interlock mechanism is designed to seal the opening. The interlock mechanism is along the edges of the opening. The interlock mechanism can be two notched members matching to each other to seal the edge of the opening by snapping the two notched members together. The interlock mechanism can also be a pair of a groove along one edge of the opening and a convex member along the other edge of the opening. The groove and the convex member lock together to form a seal when the opening is closed.

The cross section of the straw can be in different shapes, such as round, oval, square, rectangle, triangle, pentagon, hexagon and heart-shaped.

In another embodiment of the invention, the opening can also be closed by a pair of opposite magnetized materials along each edge of the opening.

Another embodiment of the invention is a straw with a closeable opening and a plurality of connective joints along the longitudinal wall of the straw. The opening has two edges along the opening. The straw can be closed by pushing the tabs along with the edges of the opening toward each other. The tabs are affixed on the edges of the opening with one tab on each edge. Each tab is affixed to a position on one edge slightly different from the other tab's affixed position. This positioning scheme is to ensure an easy separation of the tabs, thereby separating the edges of the opening from each other, when the straw is in its closed state. The tabs are preferably affixed perpendicularly to the edges of the opening, but are not necessarily affixed perpendicularly to the edges of the opening in order to achieve the intended purpose of opening the straw.

The tabs can have variety of different shapes as mentioned previously hereinabove as an example in the straw with a pair of tabs in rectangular shape.

The straw wall of the straw shown has a predetermined thickness. Depending upon the size of the straw, the thickness of the wall can be in a range approximately from 0.5 mm to 4 mm.

The plurality of the connective joints can also be called as hinges. The connective joints connect straw wall of the straw together when the straw is in an opened state. The thickness of each connective joint is thinner than the rest of the straw wall, so that the straw can be easily opened and closed. The interlock mechanism in this embodiment of the straw is similar to the interlock mechanism discussed above.

The cross section of the straw in this embodiment can also be in different shapes, such as round, oval, square, rectangle, triangle, pentagon, hexagon and heart-shaped.

In another embodiment of the invention, the opening of the straw with plurality of connective joints can also be closed by a pair of opposite magnetized materials along each edge of the opening as discussed above.

There is yet another embodiment of a straw with two closeable openings and a pair of tabs. The openings are along the longitudinal wall of the straw. Each opening of the openings has two edges along their respective openings. The straw can be closed by pushing the tabs along with the edges of the opening toward each other. The tabs are affixed on one set of edges of the respective openings with one tab on each edge. Each tab is affixed to a position on one edge slightly different from the position of the other tab on the same side of the opening. This positioning scheme is to ensure an easy separation of the tabs, thereby separating the edges of their respective openings from each other, when the straw is in its closed state. The tabs can have variety of different shapes as mentioned previously hereinabove as an example in the straw with a pair of tabs in rectangular shape.

The straw wall has a predetermined thickness. Depending upon the size of the straw, the thickness of the wall can be in a range approximately from 0.5 mm to 4 mm.

In the embodiment that has two openings, no connective joint is necessary to open the straw for cleaning.

The interlock mechanisms in this embodiment with two openings are designed to seal the respective openings. The interlock mechanisms are along the edges of the openings respectively. The interlock mechanisms are seals along the edges of their respective openings. The interlock mechanisms are similar to the interlock mechanism discussed above.

The cross section of the straw in this embodiment can be in different shapes, such as round, oval, square, rectangle, triangle, pentagon, hexagon and heart-shaped.

In another embodiment of the invention with the straw having two openings, the openings of the straw can also be closed by a pair of opposite magnetized materials along each edge of their respective openings as discussed.

BRIEF DESCRIPTION OF THE DRAWINGS

The invention is best understood from the following detailed description when read in conjunction with the accompanying drawings. It is emphasized that, according to common practice, the various features are schematic and of the drawings are not to-scale. On the contrary, the dimensions of the various features are schematic and arbitrarily expanded or reduced for clarity. Included in the drawings are the following figures.

DETAILED DESCRIPTION OF THE INVENTION

The invention has several embodiments to achieve the goal of having a washable and reusable straw. The straw is made of any semi-rigid materials, such as a food grade plastic. The semi-rigid materials can also be metal, such as food grade stainless steel. The straw material needs to tolerate a relatively high temperature, such as steam temperature, in order for high-enough temperature to disinfect the straw after it is washed. The straw material needs also to be flexible enough to be opened at the connective joint or hinge of the straw.

Figure 1:
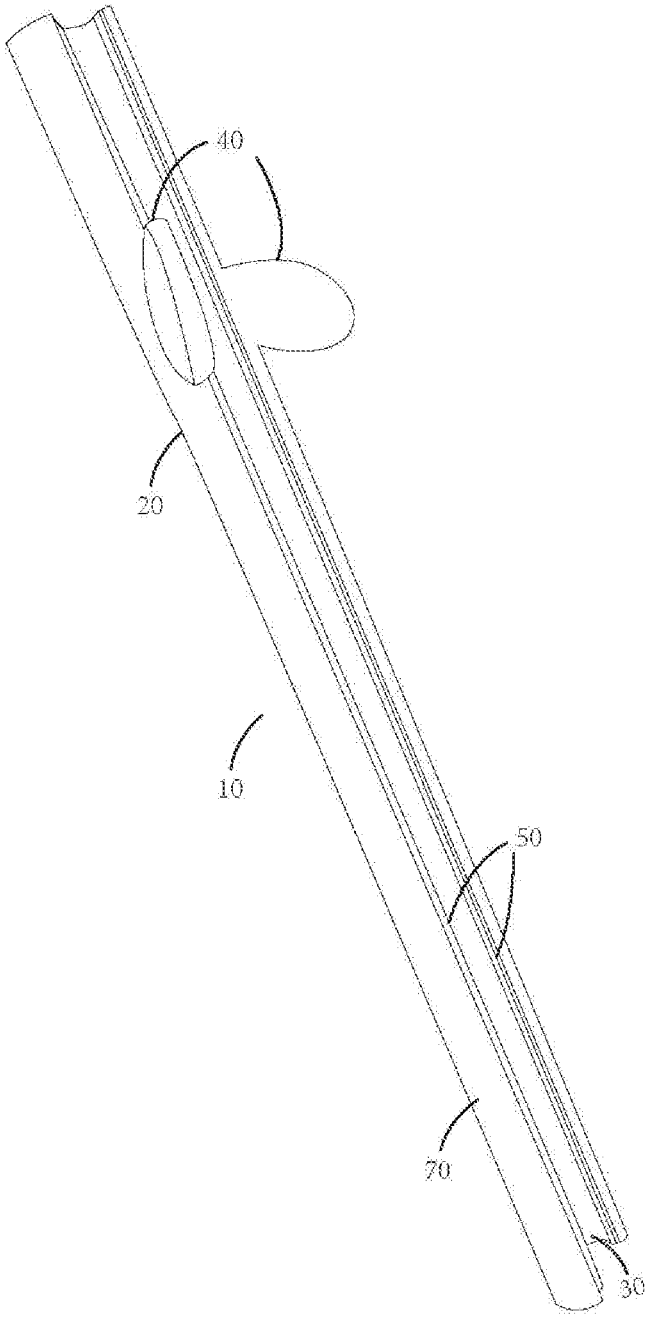
FIG. 1 is a straw in its opened state with an elongated tube body, a closeable opening, and a pair of tabs.
Figure 2:
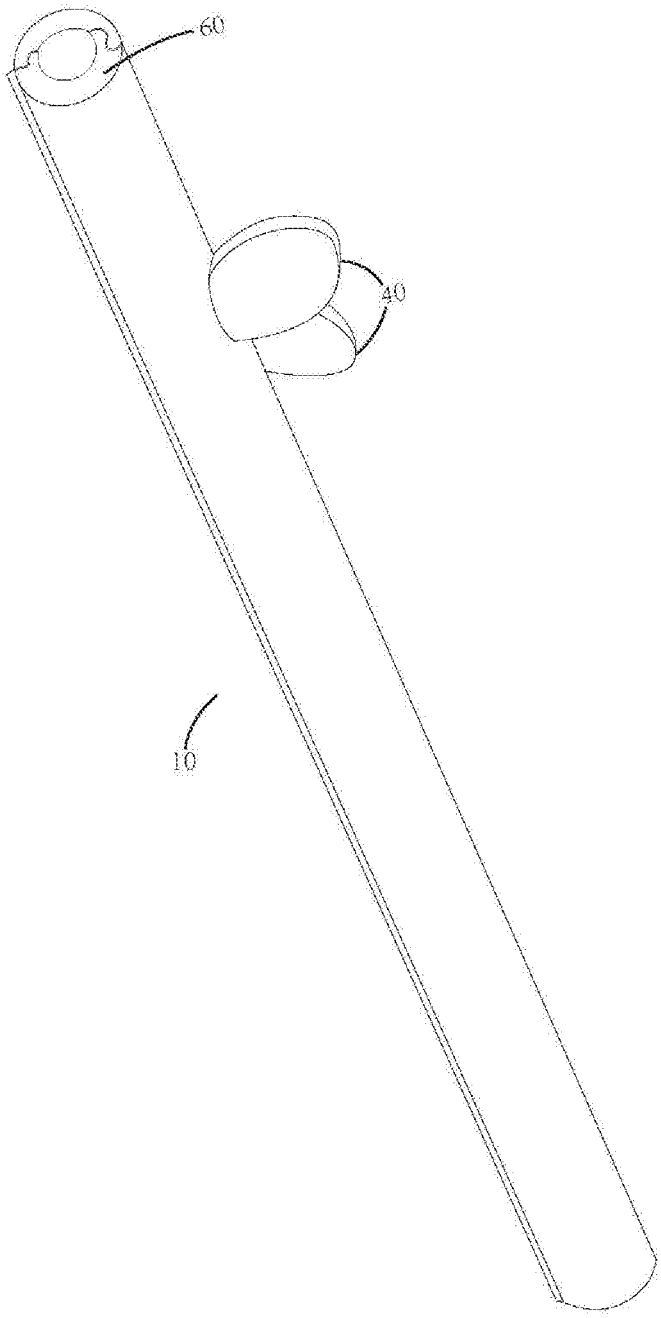
FIG. 2 is a straw in its closed state.

FIG. 1 is a typical embodiment showing a straw 10 in its opened state with an elongated tube body 20, a closeable opening 30, and a pair of tabs 40. The opening 30 is along the longitudinal wall 70 of the straw 10. The opening 30 does not need to be straight along the longitudinal wall 70 of the straw 10. In one embodiment of the invention, the opening 30 is straight along the longitudinal wall 70 of the straw 10. The opening 30 has two edges 50 along the opening 30. The straw 10 can be closed by pushing the tabs 40 along with the edges 50 of the opening 30 toward each other as shown in FIG. 2. FIG. 2 shows the straw 10 in its closed state for use. The tabs 40 are affixed on the edges 50 of the opening 30 with one tab 40 on each edge 50 as shown in FIG. 1. Each tab 40 is affixed to a position on one edge 50 slightly different from the position of the other tab 40 as shown in FIG. 2. This positioning scheme is to ensure an easy separation of the tabs 40, thereby separating the edges 50 of the opening 30 from each other, when the straw 10 is in its closed state. The tabs 40 are preferably affixed perpendicularly to the edges 50 of the opening 30, but are not necessarily affixed perpendicularly to the edges 50 of the opening 30 in order to achieve the intended purpose of opening the straw 10 for cleaning.

Figure 3:
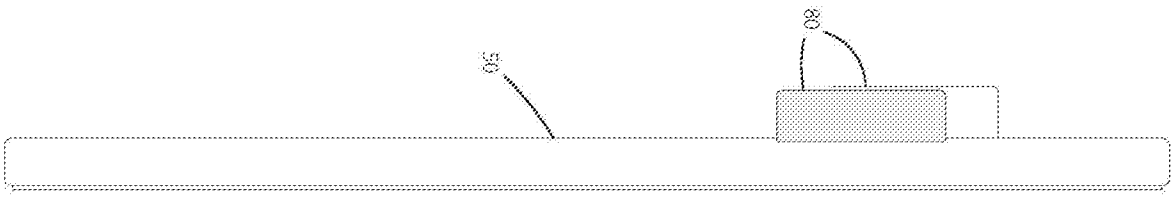
FIG. 3 is a straw with a pair of tabs in rectangular shape which are affixed to the edges of the opening in slightly different positions to each other.

The tabs 40 can have variety of different shapes. FIG. 3 shows another example of a straw 10 with a pair of tabs 80 in rectangular shape which are affixed to the edges 50 of the opening 30 in slightly different positions to each other.

The straw wall 60 has a predetermined thickness. Depending upon the size of the straw 10, the thickness of the wall 60 can be in a range approximately from 0.5 mm to 4 mm.

Figure 4A:
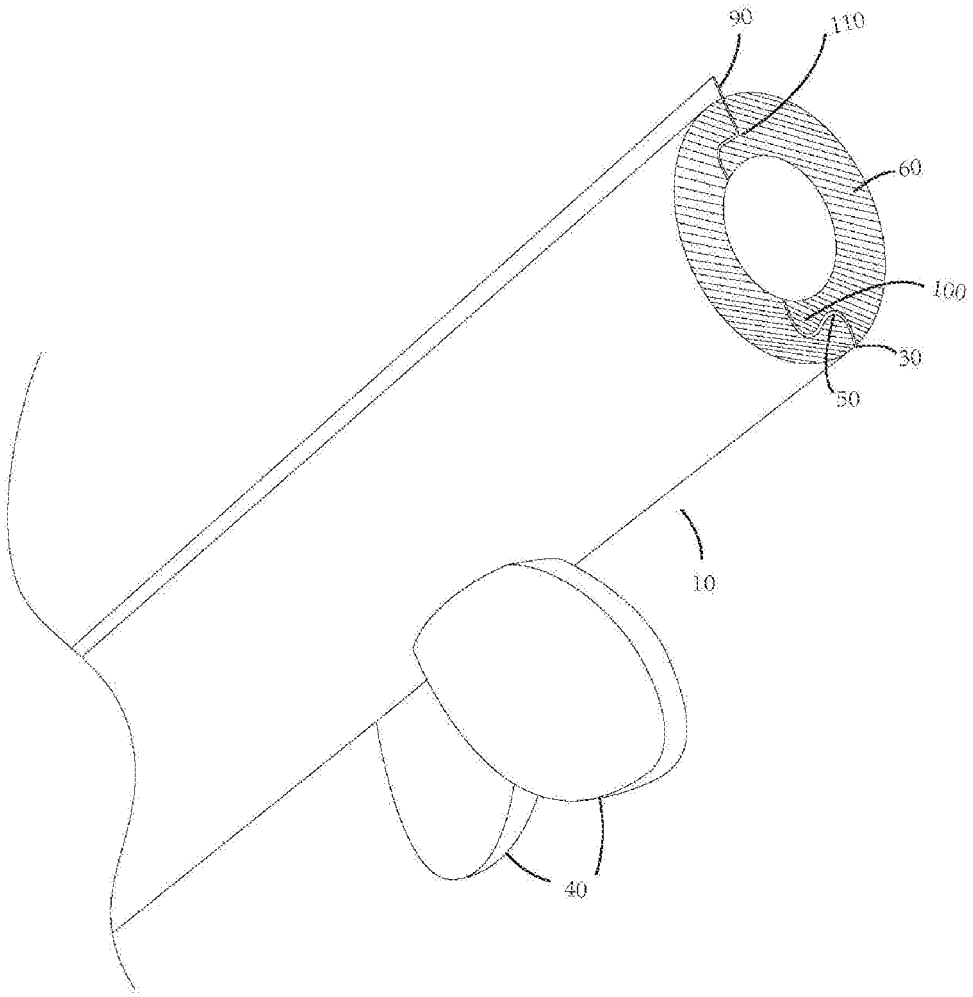
FIG. 4*a* is a straw upper section having a connective joint, an interlock mechanism at the edges of the opening, and another interlock mechanism close to the connective joint.
Figure 4B:
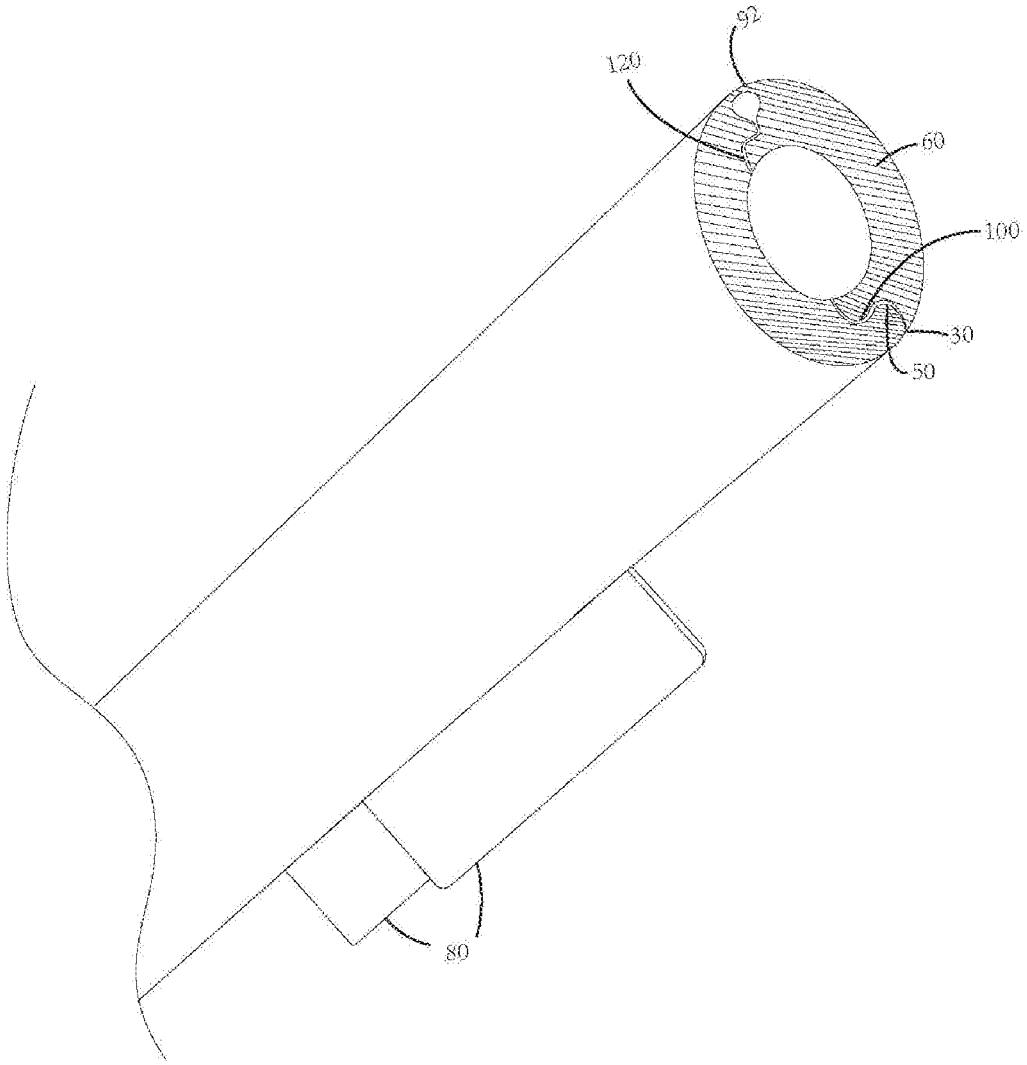
FIG. 4*b* is a straw upper section having a connective joint which has a relatively thinner wall as the straw wall with an interlock mechanism which is similar to the interlock mechanism close to the straw opening.
Figure 4C:
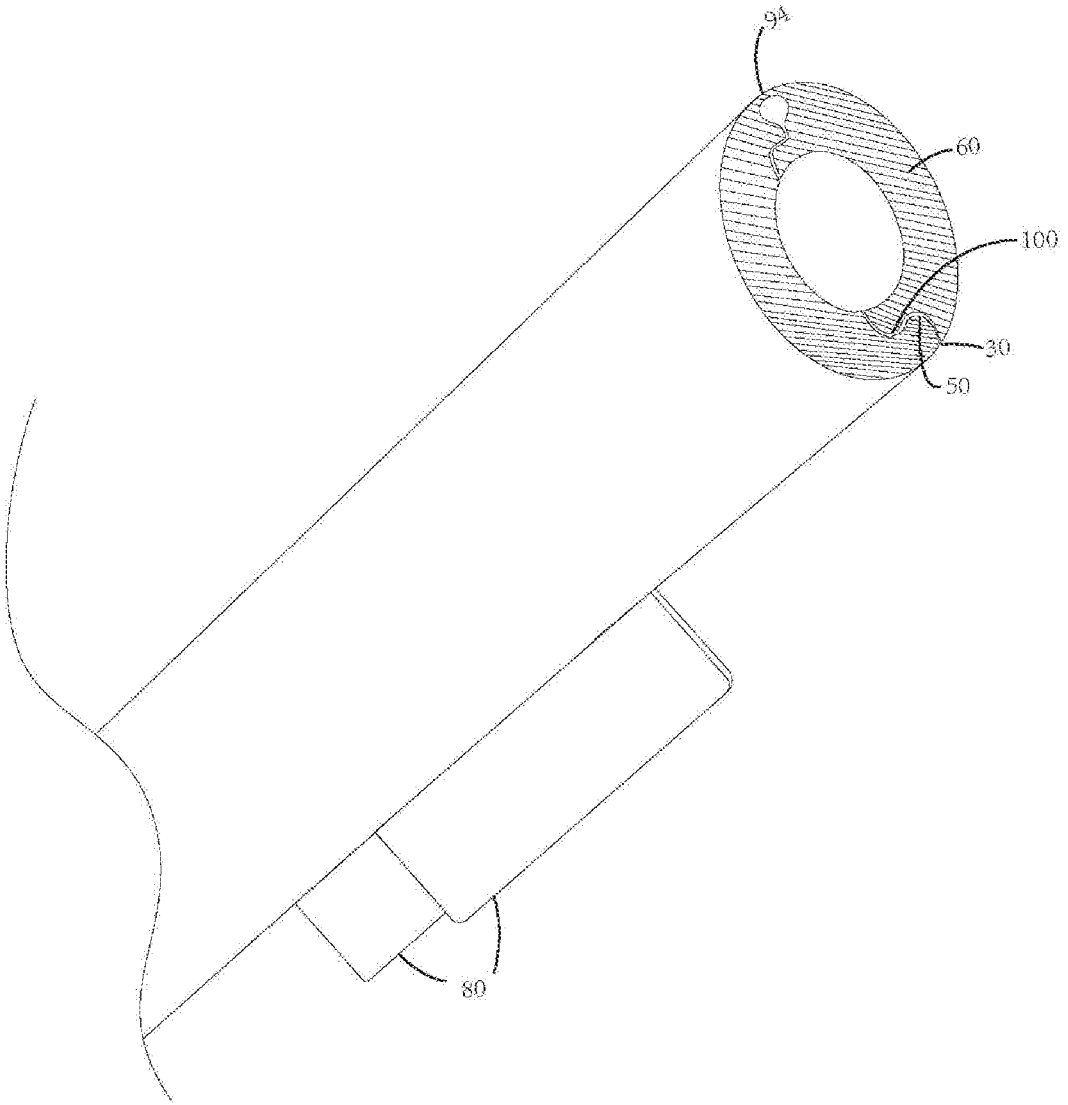
FIG. 4*c* is a straw upper section having a connective joint which also has a relatively thinner wall as the straw wall without an interlock mechanism near the connective joint.
Figure 5:
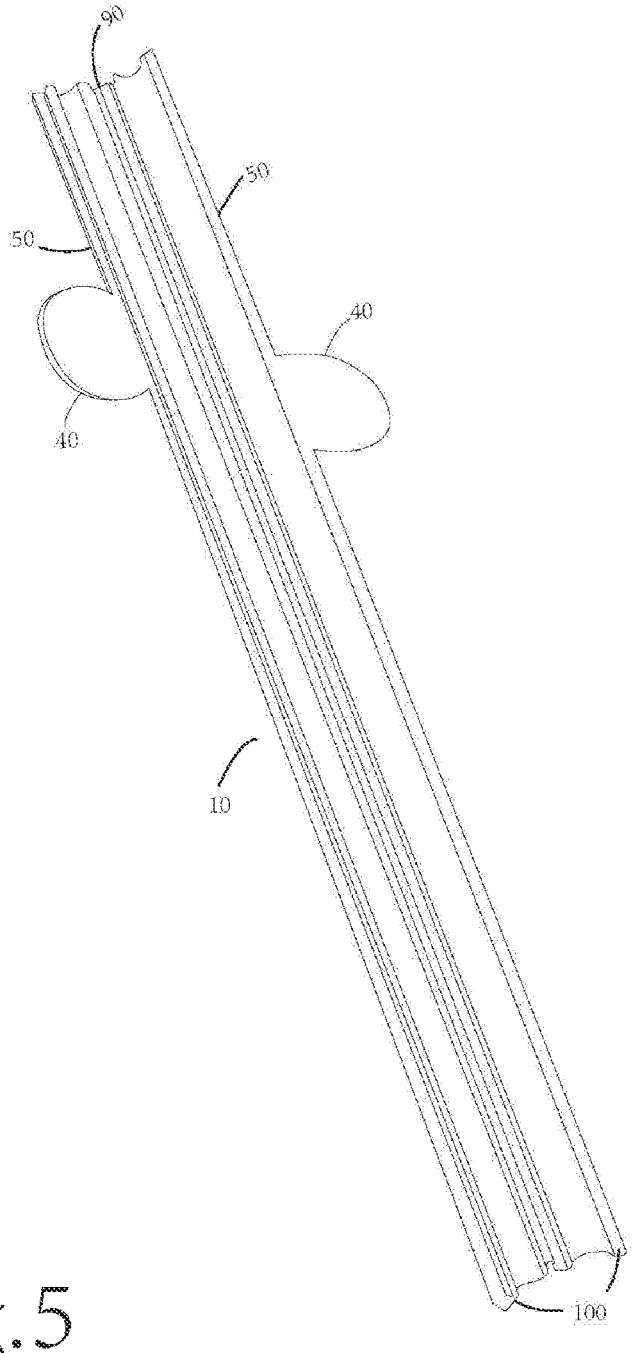
FIG. 5 is a straw having a connective joint which connects two half straw together when the straw is in an opened state.

FIG. 4*a* shows the top part of the straw 10 in FIG. 2. The straw 10 in FIG. 4*a* is in a closed state. FIG. 4*a* shows a connective joint 90, an interlock mechanism 100 at the edges 50 of the opening 30, and an interlock mechanism 110 close to the connective joint 90. The connective joint 90 can also be called as a hinge. The connective joint 90 connects two half straw 10 together when the straw 10 is in an opened state for cleaning as shown in FIG. 5. The thickness at the connective joint 90 is thinner than the rest of the straw wall 60, so that the straw 10 can be easily opened and closed. The connective joint can have many different designs such as those shown in FIG. 4*b* and FIG. 4*c*. FIG. 4*b* shows the connective joint 92 has a relatively thinner wall as the rest of the straw wall 60 with an interlock mechanism 120 which is similar to the interlock mechanism 110 shown in FIG. 4*a*. The difference between the connective joint 90 in FIG. 4*a* and the connective joint 92 in FIG. 4*b* is that the connective joint 92 is within the straw wall 60 where the connective joint 90 is outside the straw wall 60. FIG. 4*c* shows yet another design of a connective joint 94 which also has a relatively thinner wall as the rest of the straw wall 60 without an interlock mechanism near the connective joint as shown in FIG. 4*a* or FIG. 4*b*.

Figure 6:
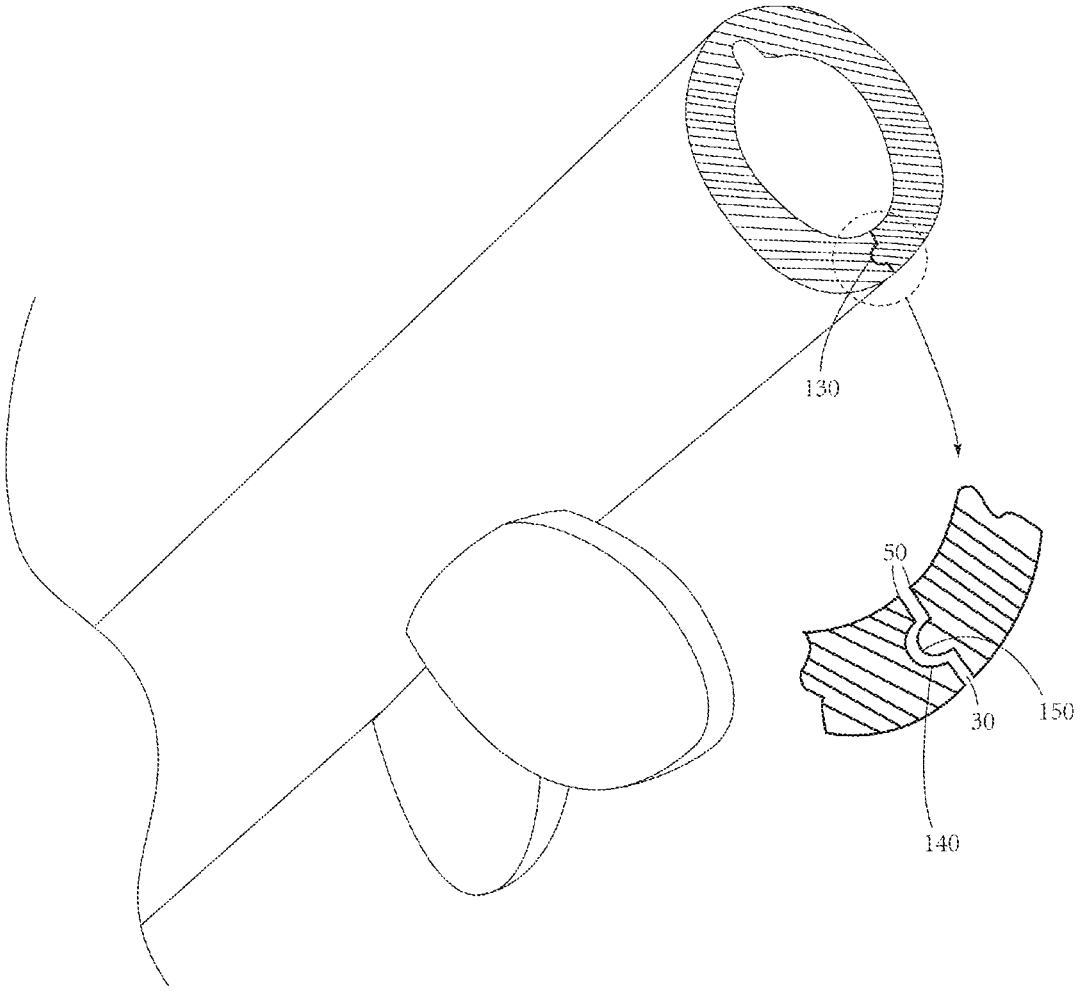
FIG. 6 is a straw upper section having another embodiment of a seal/interlock mechanism with a pair of a groove and a convex member along the edges of the opening.

The interlock mechanism 100 in FIG. 4*a* is designed to seal the opening 30 to prevent leaking of liquid while being used. The interlock mechanism 100 is along the edges 50 of the opening 30. The interlock mechanism 100 can be two notched members matching to each other as in FIG. 4*a* to seal the edge 50 of the opening 30 by snapping the two notched members together. FIG. 6 shows another embodiment for a seal/interlock mechanism 130 along the edges 50 of the opening 30. In this embodiment, there is a pair of a groove 140 along one edge 50 of the opening 30 and a convex member 150 along the other edge 50 of the opening 30. The groove 140 and the convex member 150 lock together to form the seal 130 when the opening 30 is closed as shown in FIG. 6.

Figure 7A:
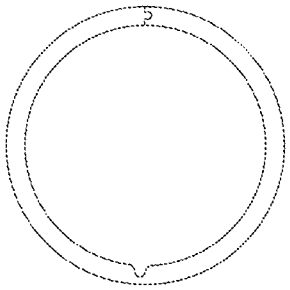
FIG. 7*a* is a straw cross-section showing round shaped of the straw.
Figure 7B:
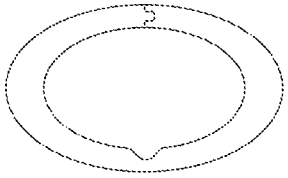
FIG. 7*b* is a straw cross-section showing oval shaped of the straw.
Figure 7C:
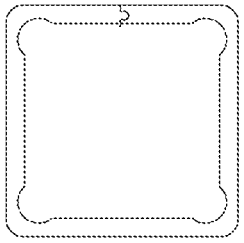
FIG. 7*c* is a straw cross-section showing square shaped of the straw.
Figure 7D:
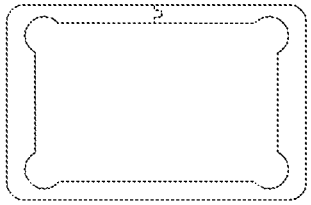
FIG. 7*d* is a straw cross-section showing rectangle shaped of the straw.
Figure 7E:
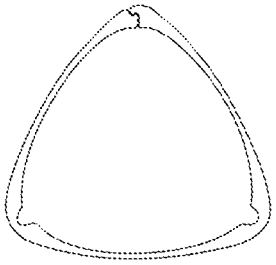
FIG. 7*e* is a straw cross-section showing triangle shaped of the straw.
Figure 7F:
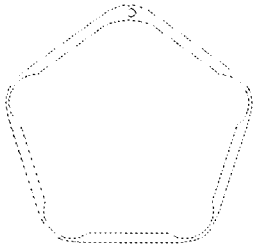
FIG. 7*f* is a straw cross-section showing pentagon shaped of the straw.
Figure 7G:
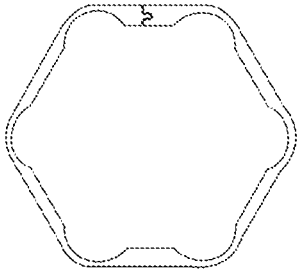
FIG. 7*g* is a straw cross-section showing hexagon shaped of the straw.
Figure 7H:
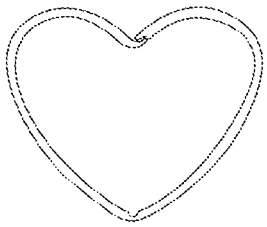
FIG. 7*h* is a straw cross-section showing heart shaped of the straw.

The cross section of the straw 10 can be in different shapes, such as round in FIG. 7*a*, oval in FIG. 7*b*, square in FIG. 7*c*, rectangle FIG. 7*d*, triangle in FIG. 7*e*, pentagon in FIG. 7*f*, hexagon in FIG. 7*g* and heart-shaped as shown in FIG. 7*h*.

Figure 8A:
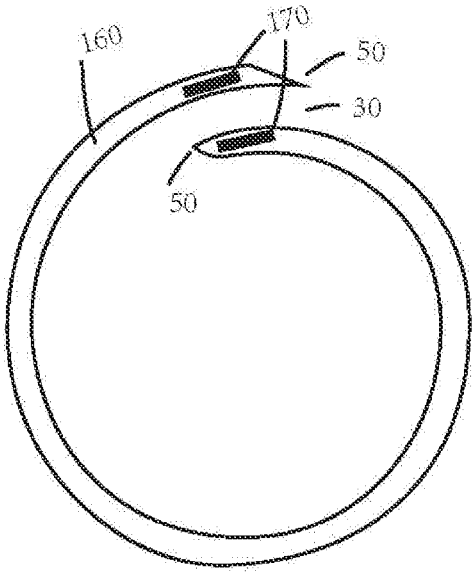
FIG. 8*a* is a straw cross-section with a pair of opposite magnetized materials along each edge of the opening with the opening being opened.
Figure 8B:
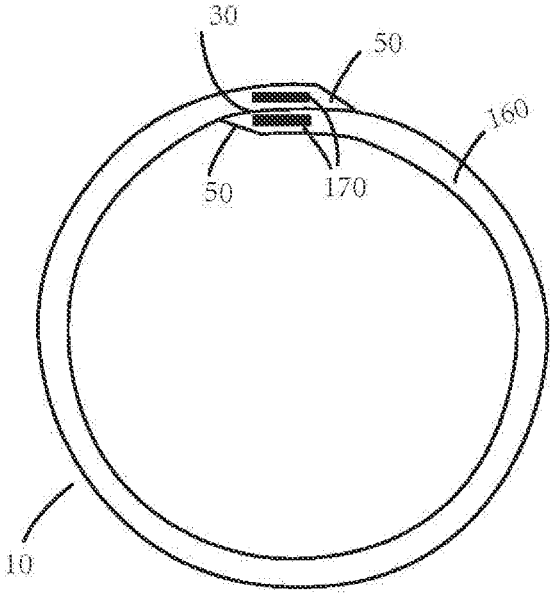
FIG. 8*b* is a straw cross-section with a pair of opposite magnetized materials along each edge of the opening with the opening being closed.

In another embodiment of the invention, the opening 30 can also be closed by a pair of opposite magnetized materials along each edge 50 of the opening 30. FIG. 8*a* shows a cross-section 160 of a straw 10 with a pair of opposite magnetized materials 170 along each edge 50 of the opening 30 with the opening being opened. FIG. 8*b* shows a cross-section 160 of a straw 10 with a pair of opposite magnetized materials 170 along each edge 50 of the opening 30 with the opening being closed.

Figure 9A:
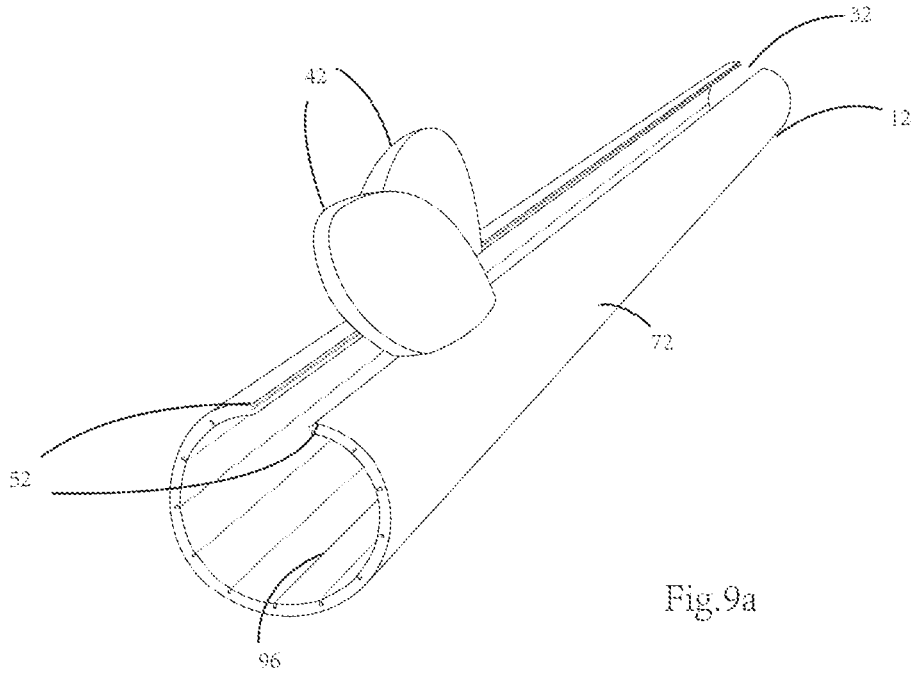
FIG. 9*a* is a straw in its opened state with a closeable opening and a plurality of connective joints along the longitudinal wall of the straw.
Figure 9B:
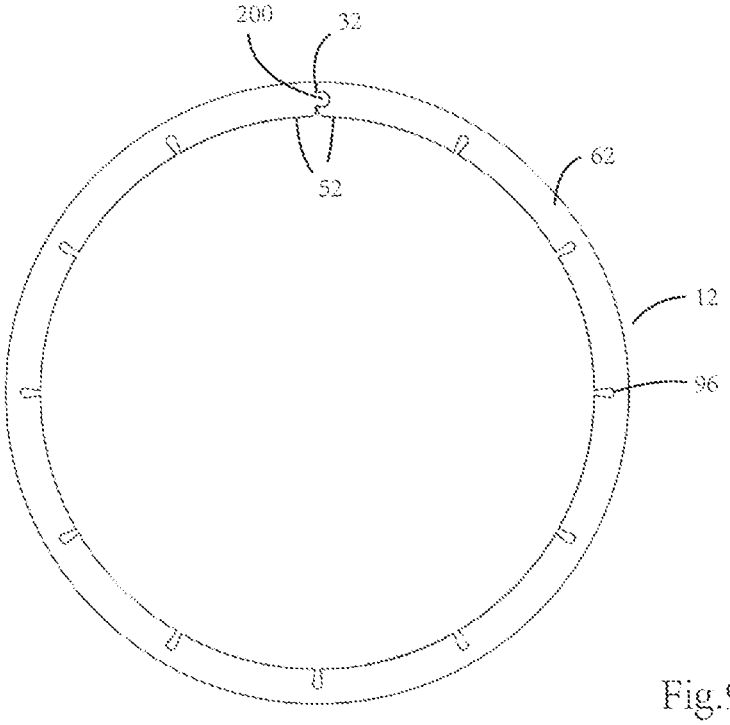
FIG. 9*b* is a straw cross-section having a plurality of connective joints along the longitudinal wall of the straw with an interlock mechanism being closed.

FIG. 9*a* is another embodiment of the invention depicting a straw 12 in its opened state with a closeable opening 32 and a plurality of connective joints 96 along the longitudinal wall 72 of the straw 12. The opening 32 does not need to be straight along the longitudinal wall 72 of the straw 12. In one embodiment of the invention, the opening 32 is straight along the longitudinal wall 72 of the straw 12 as depicted in FIG. 9*a*. The opening 32 has two edges 52 along the opening 32. The straw 12 can be closed by pushing the tabs 42 along with the edges 52 of the opening 32 toward each other. FIG. 9*b* shows a cross-section of the straw 12 in its closed state. The tabs 42 are affixed on the edges 52 of the opening 32 with one tab 42 on each edge 52 as shown in FIG. 9*a*. Each tab 42 is affixed to a position on one edge 52 slightly different from the position of the other tab 42 as shown in FIG. 9*a*. This positioning scheme is to ensure an easy separation of the tabs 42, thereby separating the edges 52 of the opening 32 from each other, when the straw 12 is in its closed state. The tabs 42 are preferably affixed perpendicularly to the edges 52 of the opening 32, but are not necessarily affixed perpendicularly to the edges 52 of the opening 32 in order to achieve the intended purpose of opening the straw 12 for cleaning.

The tabs 42 can have variety of different shapes as mentioned previously hereinabove as shown in FIG. 3 as an example in the straw 10 with a pair of tabs 80 in rectangular shape.

The straw wall 62 of the straw 12 has a predetermined thickness. Depending upon the size of the straw 12, the thickness of the wall 62 can be in a range approximately from 0.5 mm to 4 mm.

The plurality of the connective joints 96 can also be called as hinges. The connective joints 96 connect straw wall 62 of the straw 12 together when the straw 12 is in an opened state as shown in FIG. 9*a*. The thickness of each connective joint 96 is thinner than the rest of the straw wall 62, so that the straw 12 can be easily opened and closed.

The interlock mechanism 200 in FIG. 9*b* is designed to seal the opening 32 to prevent leaking of liquid. The interlock mechanism 200 is along the edges 52 of the opening 32. The interlock mechanism 200 shown in FIG. 9*b* is a seal along the edges 52 of the opening 32. The interlock mechanism 200 can be two notched members matching to each other as in FIG. 9*a* to seal the edge 52 of the opening 32 by snapping the two notched members together. The interlock mechanism 200 can also be similar to the interlock mechanism shown in FIG. 6 discussed above. The interlock mechanism 200 can also be similar the interlock mechanism 100 shown in FIG. 4*a*, FIG. 4*b* and FIG. 4*c* for the straw 10 as discussed hereinabove.

The cross section of the straw 12 can be in different shapes, such as round in FIG. 7*a*, oval in FIG. 7*b*, square in FIG. 7*c*, rectangle FIG. 7*d*, triangle in FIG. 7*e*, pentagon in FIG. 7*f*, hexagon in FIG. 7*g* and heart-shaped as shown in FIG. 7*h*.

In another embodiment of the invention, the opening 32 of the straw 12 can also be closed by a pair of opposite magnetized materials along each edge 52 of the opening 32 as discussed in FIG. 8*a* and FIG. 8*b*.

Figure 10:
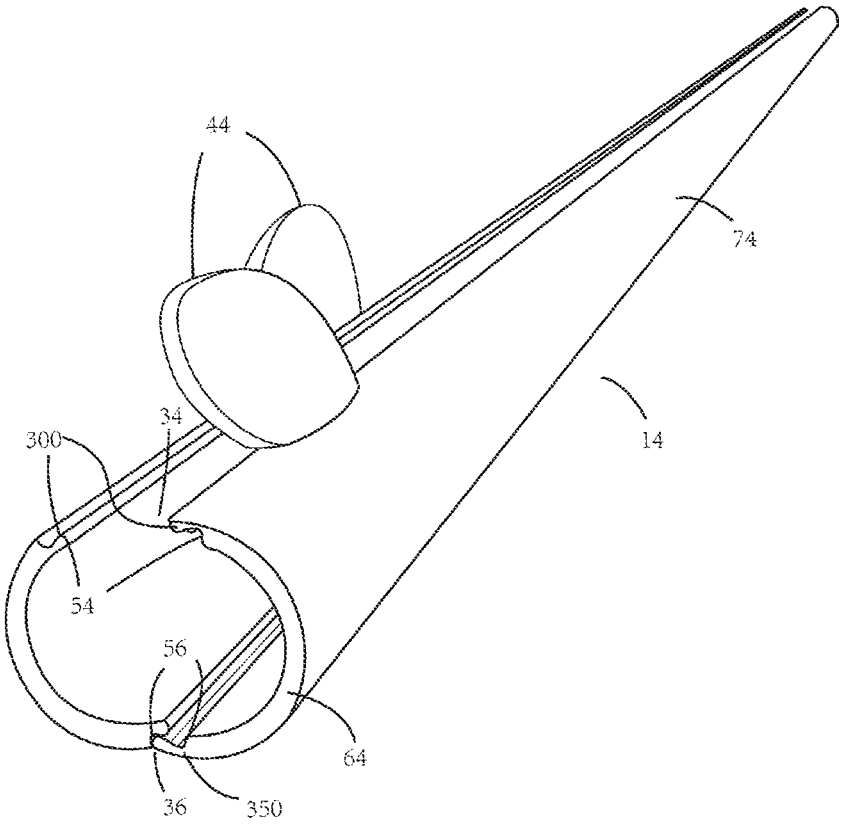
FIG. 10 is a straw in its opened state with two closeable openings, and a pair of tabs.

FIG. 10 is yet another embodiment showing a straw 14 in its opened state with two closeable openings 34 and 36, and a pair of tabs 44. The openings 34 and 36 are along the longitudinal wall 74 of the straw 14. The openings 34 and 36 do not need to be straight along the longitudinal wall 74 of the straw 14. In one embodiment of the invention, the openings 34 and 36 are straight along the longitudinal wall 74 in the opposing side of the straw 14. Each opening of the openings 34 and 36 has two edges 54 and 56 along their respective openings 34 and 36. The straw 14 can be closed by pushing the tabs 44 along with the edges 54 and 56 of the opening 34 and 36 toward each other. FIG. 10 shows the straw 14 in its opening state. The tabs 44 are affixed on one set of edges 54 or 56 of the respective openings 34 and 36 with one tab 44 on each edge 54 or 56 as shown in FIG. 10 (it is affixed on edges 54 in this instance). Each tab 44 is affixed to a position on one edge 54 or 56 slightly different from the position of the other tab 44 on the same side of the opening. This positioning scheme is to ensure an easy separation of the tabs 44, thereby separating the edges 54 or 56 of their respective openings 34 and 36 from each other, when the straw 14 is in its closed state. The tabs 44 are preferably affixed perpendicularly to the edges 54 or 56 of their respective openings 34 and 36, but are not necessarily affixed perpendicularly to the edges 54 or 54 of their respective openings 34 and 36 in order to achieve the intended purpose of opening the straw 14.

The tabs 44 can have variety of different shapes as mentioned previously hereinabove as shown in FIG. 3 as an example in the straw 10 with a pair of tabs 80 in rectangular shape.

The straw wall 64 has a predetermined thickness. Depending upon the size of the straw 14, the thickness of the wall 64 can be in a range approximately from 0.5 mm to 4 mm.

In the embodiment that has two openings as shown in FIG. 10, no connective joint is necessary to open the straw 14 for cleaning.

The interlock mechanisms 300 and 350 in FIG. 10 is designed to seal the openings 34 and 36 respectively. The interlock mechanisms 300 and 350 are along the edges 54 and 56 of the openings 34 and 36 respectively. The interlock mechanisms 300 and 350 shown in FIG. 10 are seals along the edges 54 and 56 of their respective openings 34 and 36 to prevent leaking of liquid. The interlock mechanisms 300 and 350 can each be two notched members matching to each other as in FIG. 10 to seal the edge 54 and 56 of the opening 34 and 36 respectively by snapping each pair of the notched members together. The interlock mechanisms 300 and 350 can also similar to the interlock mechanism shown in FIG. 6 discussed above. The interlock mechanisms 300 and 350 can also be like the interlock mechanism 100 shown in FIG. 4*a*, FIG. 4*b* and FIG. 4*c* for the straw 10.

The cross section of the straw 14 can be in different shapes, such as round in FIG. 7*a*, oval in FIG. 7*b*, square in FIG. 7*c*, rectangle FIG. 7*d*, triangle in FIG. 7*e*, pentagon in FIG. 7*f*, hexagon in FIG. 7*g* and heart-shaped as shown in FIG. 7*h*.

In another embodiment of the invention, the openings 34 and 36 of the straw 14 can also be closed by a pair of opposite magnetized materials along each edge 54 and 56 of their respective openings 34 and 36 as discussed in FIG. 8*a* and FIG. 8*b*.

What is claimed is:

1. A washable and reusable straw comprises:

an elongated hollow tube, made of a semi-rigid material, with at least one closeable opening having two opposing edges along a tube longitudinal wall which has a predetermined thickness; at least one pair of tabs, one on each edge of the opening, affixed to slightly different positions of the edges for separating the opening apart;

a connective joint along the tube longitudinal wall on the opposing side of the opening allowing the tube open widely when the closeable opening being unclosed, where the connective joint has a thinner thickness than the predetermined thickness of the tube longitudinal wall;

wherein the opening can be closed for liquid passing through the tube where the tube can be opened for cleaning by pushing the tabs away from each other.

2. The straw of claim 1, wherein the pair of tabs is perpendicularly affixed to different positions of the edges of the opening for separating the opening apart.

3. The straw of claim 1, wherein the closeable opening is straight along the tube longitudinal wall.

4. The straw of claim 1, wherein the elongated hollow tube has a cross-section shape selected from the group consisting of round, oval, square, rectangle, triangle, pentagon, hexagon and heart-shaped.

5. The straw of claim 1, wherein the closeable opening can be magnetically closed by affixing opposite magnetized materials along each edge of the opening.

6. The straw of claim 1, wherein the edges of the closeable opening further comprise: a groove along one edge of the closeable opening; and a convex member along the other edge of the closeable opening; wherein the convex member fits into the groove to securely close the opening.

7. The straw of claim 1, wherein the edges of the closeable opening further comprise: a pair of an interlock mechanism wherein two edges of the closeable opening lock together to seal the opening.

8. A washable and reusable straw comprises:

an elongated hollow tube, made of a semi-rigid material, with at least one closeable opening having two opposing edges along a tube longitudinal wall which has a predetermined thickness;

at least one pair of tabs, one on each edge of the opening, affixed to slightly different positions of the edges for separating the opening apart;

a plurality of connective joints along the tube longitudinal wall equally situated on the side of the tube longitudinal wall allowing the pipette open widely when the closeable opening being unclosed, where the connective joints have thinner thicknesses than the predetermined thickness of the tube longitudinal wall;

wherein the opening can be closed for liquid passing through the tube where the tube can be opened for cleaning by pushing the tabs away from each other.

9. The straw of claim 8, wherein the pair of tabs is perpendicularly affixed to different positions of the edges of the opening for separating the opening apart.

10. The straw of claim 8, wherein the closeable opening is straight along the tube longitudinal wall.

11. The straw of claim 8, wherein the elongated hollow tube has a cross-section shape selected from the group consisting of circle, oval, square, rectangle, triangle, pentagon, hexagon and heart-shaped.

12. The straw of claim 8, wherein the closeable opening can be magnetically closed by affixing opposite magnetized materials along each edge of the opening.

13. The straw of claim 8, wherein the edges of the closeable opening further comprise: a groove along one edge of the closeable opening; and a convex member along the other edge of the closeable opening; wherein the convex member fits into the groove to securely close the opening.

14. The straw of claim 8, wherein the edges of the closeable opening further comprise: a pair of an interlock mechanism wherein two edges of the closeable opening lock together to seal the opening.

15. A washable and reusable straw comprises:

an elongated hollow tube, made of a semi-rigid material, with two closeable openings, which can be magnetically closed by affixing opposite magnetized materials along each edge of the openings, on the opposite side of a tube longitudinal wall, having two opposing edges along the tube longitudinal wall on each opening;

at least one pair of tabs, one on each edge of one opening, affixed to slightly different positions of the edges for separating the opening apart;

wherein the opening can be closed for liquid passing through the tube where the tube can be opened for cleaning by pushing the tabs away from each other.

16. A washable and reusable straw comprises:

an elongated hollow tube, made of a semi-rigid material, with two closeable openings on the opposite side of a tube longitudinal wall, having two opposing edges along the tube longitudinal wall on each opening, wherein the edges of the closeable openings further comprise:

a groove along each edge of the closeable openings; and a convex member along the other edge of the closeable openings;

wherein the convex members fit into the grooves to securely close the opening;

at least one pair of tabs, one on each edge of one opening, affixed to slightly different positions of the edges for separating the opening apart;

wherein the opening can be closed for liquid passing through the tube where the tube can be opened for cleaning by pushing the tabs away from each other.

17. A washable and reusable straw comprises:

an elongated hollow tube, made of a semi-rigid material, with two closeable openings on the opposite side of a tube longitudinal wall, having two opposing edges along the tube longitudinal wall on each opening, wherein the edges of the closeable opening further comprise: a pair of an interlock mechanism wherein two edges of the closeable opening lock together to seal the opening;

at least one pair of tabs, one on each edge of one opening, affixed to slightly different positions of the edges for separating the opening apart;

wherein the opening can be closed for liquid passing through the tube where the tube can be opened for cleaning by pushing the tabs away from each other.

* * * * *